United States Patent [19]

Miller

[11] Patent Number: 5,026,042

[45] Date of Patent: Jun. 25, 1991

[54] SHEET FEEDER FOR COPIERS AND PRINTERS

[75] Inventor: Donald P. Miller, Walworth, N.Y.

[73] Assignee: Xerox Corporation, Stamford, Conn.

[21] Appl. No.: 468,394

[22] Filed: Jan. 22, 1990

[51] Int. Cl.[5] ..... B65H 3/06; B65H 3/52

[52] U.S. Cl. ..... 271/119; 271/121; 271/127

[58] Field of Search ..... 271/127, 121, 124, 119, 271/22, 170

[56] References Cited

U.S. PATENT DOCUMENTS

| | | | |
|---|---|---|---|
| 748,279 | 12/1903 | Hallberg | 271/121 |
| 4,032,136 | 6/1977 | Komaba et al. | 271/160 |
| 4,106,763 | 8/1978 | Tani et al. | 271/9 |
| 4,307,878 | 12/1981 | Kono | 271/22 |
| 4,350,328 | 9/1982 | Katakura et al. | 271/22 |
| 4,381,860 | 5/1983 | Silverberg | 271/10 |
| 4,515,357 | 5/1985 | Hamlin | 271/120 |
| 4,635,919 | 1/1987 | Habich | 271/119 X |
| 4,786,042 | 11/1988 | Stemmle | 271/9 |

FOREIGN PATENT DOCUMENTS

| | | | |
|---|---|---|---|
| 251819 | 1/1988 | European Pat. Off. | 271/167 |
| 74843 | 4/1988 | Japan | 271/167 |

*Primary Examiner*—Richard A. Schacher

[57] ABSTRACT

A sheet feeder for handling envelopes and the like in which a flexible retard pad projects into the feeder discharge opening, the upper part of the pad being unsupported with the lower part supported in an inclined position so that on feeding movement of an envelope from the tray, the leading edge of the topmost envelope strikes the unsupported part of the pad to deflect the pad out of the way while the leading edges of other envelopes in the tray that are carried forward by feeding of the topmost envelope engage the supported part of the retard pad and are prevented by the pad from being fed.

8 Claims, 4 Drawing Sheets

SHEET FEEDER FOR COPIERS AND PRINTERS

The present invention relates to sheet feeders for electrostatographic reproduction machines, and more particularly to an improved sheet feeder for handling relatively stiff sheet material such as envelopes.

Most reproduction machines are used to produce copies or prints on normal weight paper sheet stock. While the weight and stiffness of the sheets used may vary, the range is limited. Further, the sheets are not usually doubled or plied together as in the case of envelopes. Thus, the sheet feeders can be and are designed principally to handle single sheets and when they are used to feed heavier and plied sheet stock such as envelopes too, suffer a drop in reliability with resulting increase in jams and misfeeds.

In the prior art, U.S. Pat. No. 4,786,042 to Stemmle discloses an adjustable sheet cassette having independently movable sheet length and width guides to accommodate a stack of copy sheets of various sizes, with a pivoting sheet stack support platform which engages the uppermost sheet in the stack with the sheet feed roll. U.S. Pat. No. 4,032,136 to Komaba et al is similar, with adjustable sheet size cassette, a pivoted sheet stack support, and springs for biasing the support together with the sheet stack into contact with the sheet feed roll. U.S. Pat. Nos. 4,106,763 (Tani et al), 4,307,878 (Kono), and 4,350,328 (Katakura et al) disclose sheet cassettes in which various pivoting spring activated configurations are used to pivot the cassette base together with the stack of sheets resting thereon upwardly into feeding contact with the sheet feed roll of a copying machine. And, U.S. Pat. Nos. 4,515,357 (Hamlin) and 4,381,860 (Silverberg) disclose paddle type retard feeders in which a rotating member, generally in the shape of a paddle wheel, is used to separate and feed one sheet at a time from a stack of sheets.

In contrast, the present invention provides a feeder for feeding sheets of various thickness and stiffness including envelopes in electrostatographic reproduction machines comprising the combination of: a tray for supporting a stack of sheets for feeding, the tray having a sheet discharge end and being supported for pivotal movement adjacent the end opposite the discharge end; sheet feeding means above the tray adapted when actuated to feed the topmost one of the sheets in the sheet stack from the tray; the tray having a cover with opening means for permitting the sheet feeding means to engage and feed the topmost sheet in the sheet stack from the tray; tray biasing means for pivoting the tray upwardly toward the cover so that the topmost sheet in the sheet stack contacts the cover adjacent the tray sheet discharge end; and a flexible retard pad extending above the tray to a point adjacent the cover at the sheet discharge end of the tray, the pad cooperating with the cover to form a sheet discharge opening through which sheets are discharged from the tray by the sheet feeding means, the height of the pad being such that the pad normally interferes with discharge of sheets through the discharge opening; actuation of the sheet feeding means moving the topmost sheet in the sheet stack toward the discharge opening whereby the leading edge of the topmost sheet engages and deflects the retard pad in the direction of movement of the sheet, movement of the topmost sheet causing sheets below the topmost sheet to move as a result of contact between the sheets with the topmost sheet whereby the leading edge of the moving sheets engage the retard pad in the direction of movement of the sheets, deflection of the retard pad allowing the topmost sheet to be discharged from the tray through the discharge opening while engagement of the additional sheets with the retard pad prevents discharge of the additional sheets with the topmost sheet.

The invention further relates to a feeder for feeding relatively stiff sheets in electrostatographic reproduction machines comprising the combination of: a tray for supporting the sheets in a stack, the tray having a sheet discharge end; sheet feeding means above the tray adapted when actuated to feed the topmost one of the sheets in the sheet stack from the tray; sheet retainer means above the stack of sheets in the tray, at least a part of the retainer means being adjacent the tray sheet discharge end; and a flexible closure downstream of the tray discharge end, the closure cooperating with the retainer means part to form a normally closed sheet discharge opening through which sheets are fed by the sheet feeding means; actuation of the sheet feeding means moving the topmost sheet in the sheet stack toward the discharge opening to cause the leading edge of the topmost sheet to strike the closure and deflect the closure outwardly in the direction of movement of the topmost sheet whereby to open the sheet discharge opening and permit discharge of the topmost sheet from the tray through the discharge opening, the closure returning to the closed position following passage of the topmost sheet through the sheet discharge opening.

IN THE DRAWINGS

Figure 1:
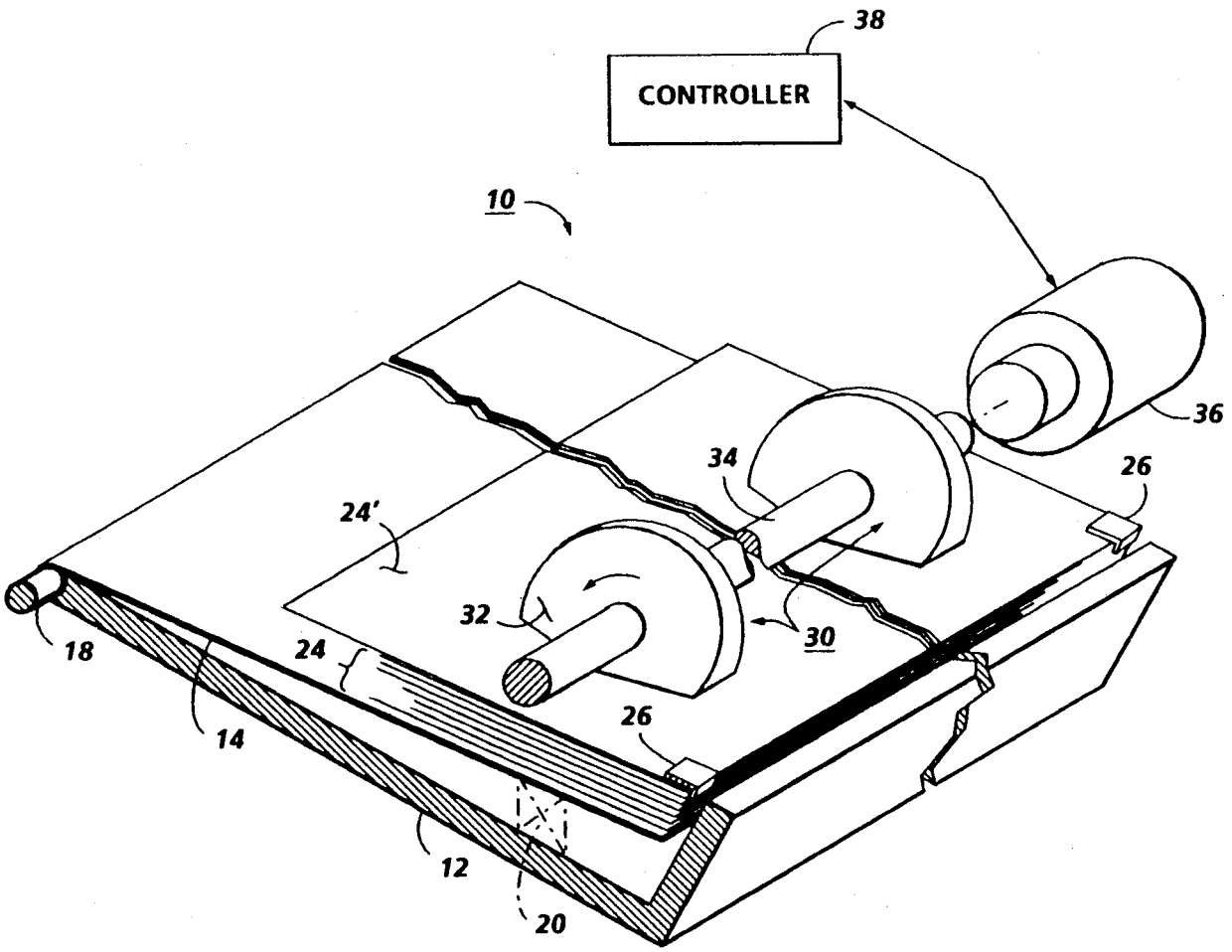
FIG. 1 PRIOR ART
FIG. 1 is an isometric view of a typical prior art cassette type buckle sheet feeder.

In FIG. 1 there is shown a sheet feeder in the form of a paper cassette 10 of the type used with the Xerox 4045 electronic printer ("Xerox" and "Xerox 4045" are registered Trademarks of Xerox Corporation). Cassette 10 has a base 12 within which a tray 14 is located, tray 14 being pivotally attached to base 12 at the end opposite to the sheet discharge end of cassette 10 as by pins 18. A spring 20 disposed between base 12 and tray 14 adjacent the opposite or sheet discharge end of cassette 10 biases tray 14 upwardly, in effect causing tray 14 to pivot about pins 18 in a counter clockwise direction.

Paper to be fed is in the form of sheets 24, a supply of sheets being stacked on tray 14 when cassette 10 is loaded. A snubber 26 is provided at each corner of cassette 10 at the sheet discharge end, snubbers 26 partially overlaying the front or leading edge of the topmost sheets in the stack of sheets on tray 14. Snubbers 26 are pivotally attached to the sides of base 12 to enable snubbers 26 to be swung out of the way when loading tray 14.

To feed sheets 24 from cassette 10, a pair of segmented feed rolls 30 are used, each roll 30 having a circular feeding segment 32. Feed rolls 30 are carried by a shaft 34 rotatably supported in the printer frame structure (not shown). Feed rolls 30 are positioned above cassette 10 and somewhat inward from snubbers 26. On rotation of feed rolls 30, the sheet feeding segment 32 thereof engages the topmost sheet 24' in cassette 10. Shaft 34 is drivingly coupled to a step motor 36 which when actuated rotates feed rolls 30 through one revolution in the direction shown by the solid line arrow. Motor 36 is actuated in response to a command for a sheet from the printer controller 38 during the printing cycle.

In use, spring 20 biases tray 14 upwardly to maintain the topmost sheet 24' in the sheet stack in contact with snubbers 26 so that the requisite normal force to ensure reliable feeding by feed rolls 30 is provided. Snubbers 26 provide the necessary multi-sheet discrimination and sheet separation by causing the topmost sheet to buckle when fed and thereby separate from the stack of sheets in tray 14.

However, relatively stiff sheet material, that is, material that will not readily buckle such as envelopes, is difficult to feed from buckle feeders of the type described above. Where material in this type is required to be fed, the buckling effected by corner snubbers may not provide sufficient multi-sheet discrimination to assure reliable feeding.

Figure 2:
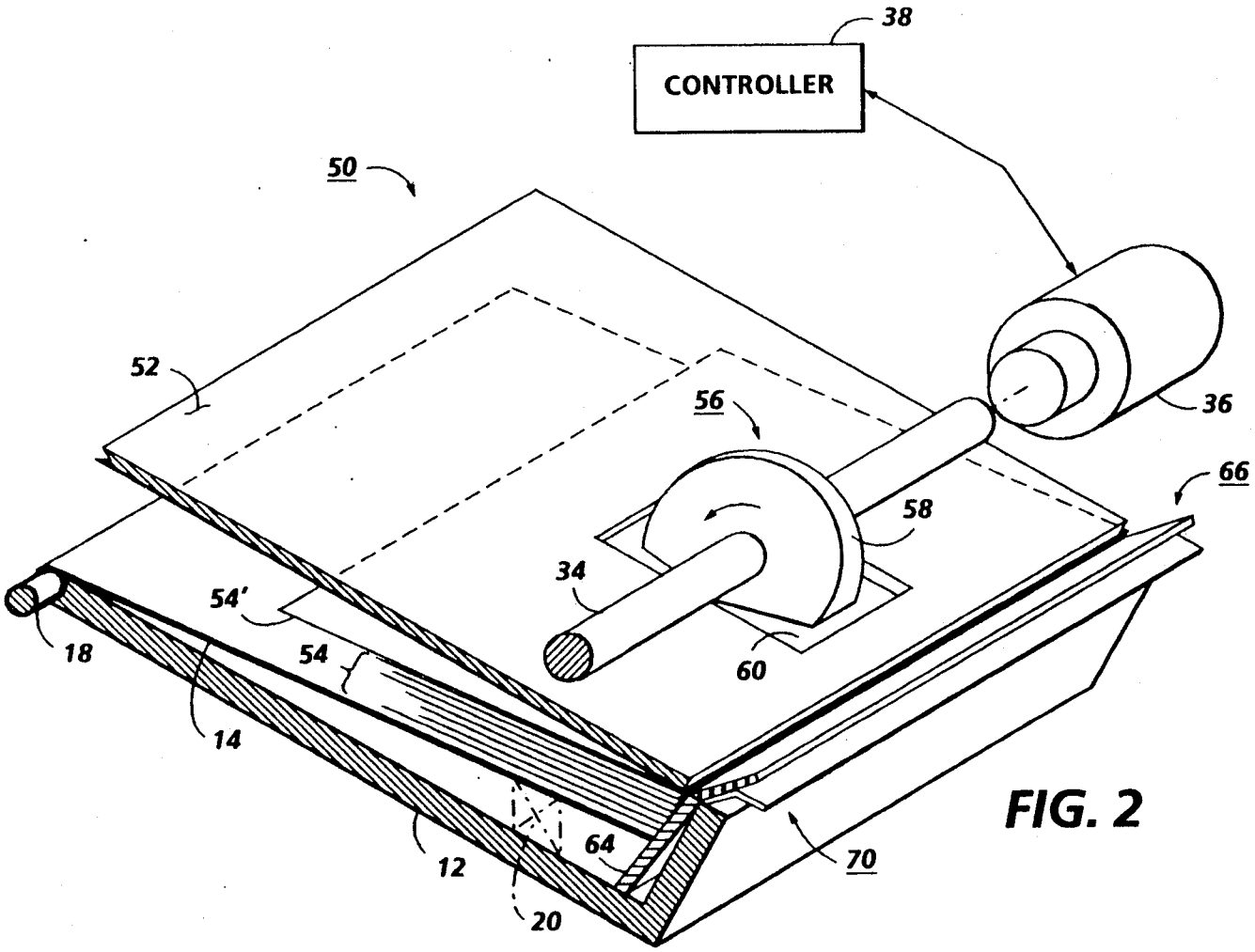
FIG. 2 is an isometric view of the sheet feeder of the present invention prior to feeding a sheet.
Figure 3:
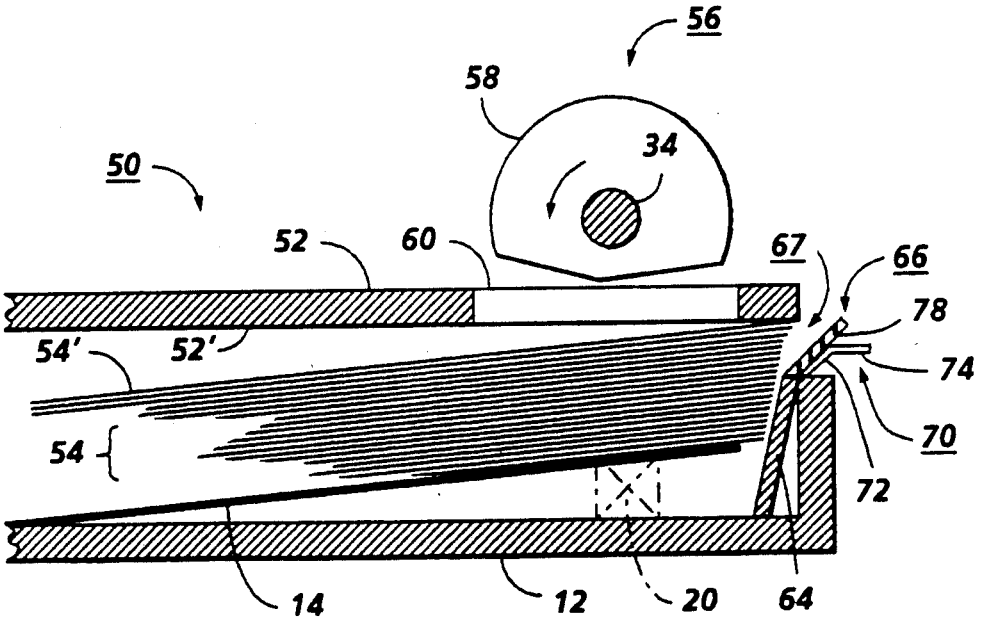
FIG. 3 is a side view of the sheet feeder shown in FIG. 2 prior to feeding a sheet.
Figure 4:
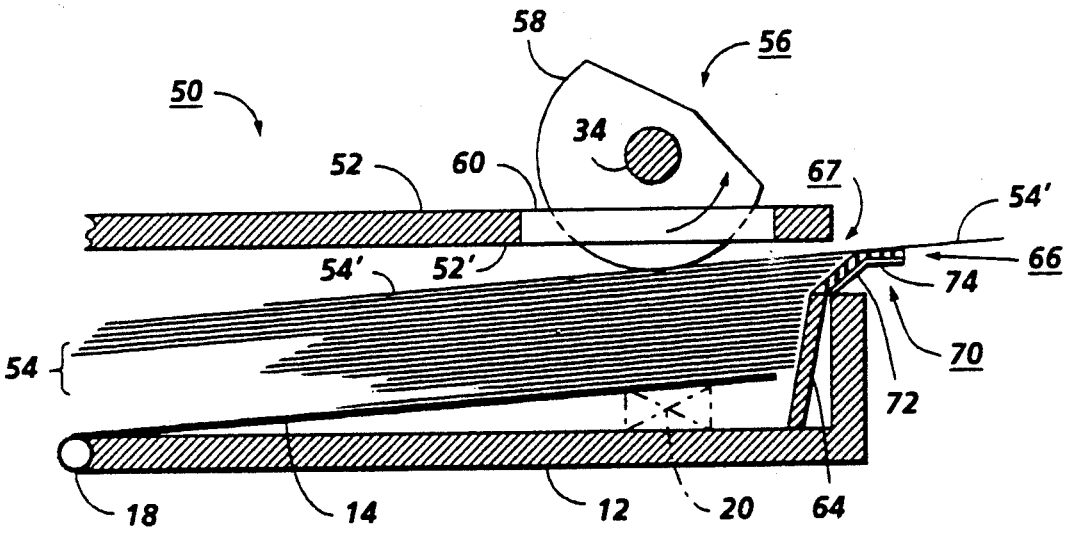
FIG. 4 is a side view of the sheet feeder shown in FIG. 2 when feeding a sheet.

Referring to FIGS. 2–4 where like numbers refer to like parts, there is shown the improved sheet feeder cassette, designated generally by the numeral 50, of the present invention. Cassette 50 has a retainer shown here in the form of a cover 52 against which the stack of sheets (shown and described here as envelopes 54) resting on tray 14 are pressed by spring 20. A single feed roll 56 with circular feed segment 58 is carried on shaft 34, feed roll 56 being disposed above cassette 50 substantially in the center thereof. Cover 52 is provided with an opening 60 therethrough opposite feed roll 56 to enable feed segment 58 of roll 56 to come into feeding contact with the envelopes on tray 14.

The side 64 of base 12 adjacent the cassette discharge end is inclined to provide a sloping surface against which the lead edges of the envelopes in tray 14 are abutted on loading of envelopes 54 into cassette 50. As a result, envelopes are pre-shingled to enhance subsequent separation and feeding.

To control and limit feeding to one envelope at a time, a retard pad 66 is provided along the upper edge of side 64, the height of pad 66 being such that the end of pad 66 is substantially level with the inside 52' of cover 52. As a result, cover 52 and pad 66 cooperate to form a sheet discharge opening 67 through which envelopes are fed. While the end of pad 66 in the undeflected state is shown to be substantially at the same level as the inside of cover 52, it will be understood that the height of pad 66 may be varied in order to fine tune feeder 50 for optimum feeding. As a result, the height of pad 66 in the undeflected state may be somewhat above or below cover 52. To facilitate adjustment, the pad support 70 may be mounted for adjustable raising and lowering movement by suitable means (not shown) to allow pad 66 to be adjusted upwardly or downwardly as required for optimum feeding and reliability.

Pad 66 is composed of a suitable flexible material having the frictional properties required to retard and control movement of envelopes 54 as will appear. One suitable material for pad 66 is silicon. Other suitable materials such as polyisoprene may be envisioned.

Retard pad support 70 comprises a rigid sheet-like part mounted on the upper edge of side 64 next to retard pad 66 such that support 70 projects in a generally upward direction behind retard pad 66. The angle of inclination of the lower section 72 of pad 70 is somewhat greater than that of side 64 of base 12 while the upper section 74 of support 70 extends in an approximately horizontal direction. The relation between the height of the point at which sections 72 and 74 meet and the inside 52' of top cover 52 is chosen to form, in cooperation with retard pad 60, an opening designed to limit feeding to one envelope at a time.

The lower part 76 of retard pad 66 abuts against and is fastened to the inside surface of lower section 72 of pad support 70 while the upper part 78 of pad 66 normally diverges from the upper section 74 of support 78 as seen in FIGS. 2 and 3. As a result, the upper part 78 of pad 66 normally is unsupported against deflection and thus free to deflect or bend until the pad upper part 78 strikes the upper section 74 of pad support 70 as seen in FIG. 4.

In operation, on a command to feed an envelope, motor 36 is actuated to rotate feed roll 56 through one revolution in the direction shown by the solid line arrow. As feed roll 56 rotates, the feeding segment 58 thereof enters opening 60 in cover 52 to engage the topmost envelope 54 in the stack of envelopes resting on tray 14. Engagement of feed roll segment 58 with envelope 54' feeds the envelope forward toward retard pad 66 and the envelope discharge opening between cover 52 and pad 66. However, as a result of the pressure between envelopes in the stack from the bias imposed by spring 20, envelopes 54 under and below the topmost envelope 54' are also drawn forward toward opening 67 due to the frictional contact between the envelopes of the stack.

As the envelopes including the topmost envelope move forward, the leading edges of the envelopes 54 contact retard pad 66. Since the lower part 76 of pad 66 is supported against deflection by the rigid retard pad support 70, movement of those envelopes engaging that part of retard pad 66 is stopped, leaving the envelopes in a further shingled condition as shown in FIG. 4. However, the topmost envelope 54', which is directly engaged by and is being fed forward by feed roll 56, impinges against the upper unsupported part 78 of retard pad 66, causing the pad to bend or deflect downwardly. This enables the envelope to pass through the tray discharge opening 67. Bending or deflecting of the upper part 78 of retard pad 66 continues until the pad strikes the upper section 74 of pad support 70. This action effectively opens the discharge opening 67, allowing the topmost envelope 54' to be fed from cassette 50. At the same time, feeding of the envelopes below the topmost envelope in the stack is prevented by retard pad 66. After passage of the envelope being fed, the upper part 78 of retard pad 66 springs back to the raised position shown in FIG. 3 pending feeding of the next envelope.

While cassette 50 has been described and shown as feeding envelopes 54, other relatively stiff and/or multiply stock are also accommodated. And while the invention has been described in connection with a cassette type sheet feeder, the invention is not limited to cassette feeders but may be used with other types of sheet feeders as well.

While tray 14 is shown and described as pivotally supported at one end on base 12, tray 14 may instead be supported for elevator type up and down movement. While a cover 52 has been shown, any suitable retainer for retaining the stack of sheets in position on tray 14 against the bias of spring 20 may be envisioned. Further, cover 52 or other retainer may be dispensed with and one or more full feed rolls substituted for the segmented feed roll 56. In that circumstance, the full feed roll (s)

would function as both a sheet feeding device and as a retainer against which the stack of sheets in tray 14 are compressed by spring 20.

While retard pad 66 and support 70 therefor have been shown to be continuous and extending across the width of tray 14, pad 66 (and support 70) may instead comprise one or more relatively small segments located at strategic intervals along the discharge side of tray 14.

While the invention has been described with reference to the structure disclosed, it is not confined to the details set forth, but is intended to cover such modifications or changes as may come within the scope of the following claims.

I claim:

1. A sheet feeder for feeding sheets of various thickness and stiffness including envelopes in electrostatographic reproduction machines comprising the combination of:

(a) a tray for supporting a stack of sheets for feeding, said tray having a sheet discharge end, said tray being supported for pivotal movement adjacent the end opposite said discharge end;

(b) sheet feeding means above said tray adapted when actuated to feed the topmost one of the sheets in said sheet stack from said tray;

(c) said tray having a cover, said cover having opening means for permitting said sheet feeding means to engage and feed said topmost sheet in said sheet stack from said tray;

(d) tray biasing means for pivoting said tray upwardly toward said cover so that said topmost sheet in said sheet stack contacts said cover adjacent said tray sheet discharge end;

(e) an inclined surface adjacent said sheet discharge end for engaging the leading edge of the sheets in said sheet stack to pre-shingle the sheets in said tray; and (f) a flexible retard pad extending above said tray to a point adjacent said cover at the sheet discharge end of said tray, said pad cooperating with said cover to form a sheet discharge opening through which sheets are discharged from said tray by said sheet feeding means, the height of said pad being such that said pad normally interferes with discharge of sheets through said discharge opening;

(g) actuation of said sheet feeding means moving the topmost sheet in said sheet stack toward said discharge opening, whereby the leading edge of said topmost sheet engages and deflects said retard pad in the direction of movement of said sheet;

(h) movement of said topmost sheet causing sheets below said topmost sheet to move as a result of contact between said sheets with said topmost sheet whereby the leading edge of said moving sheets engage said retard pad in the direction of movement of said sheets;

deflection of said retard pad allowing said topmost sheet to be discharged from said tray through said discharge opening while engagement of said additional sheets with said retard pad stops movement of said additional sheets and prevents discharge of said additional sheets with said topmost sheet.

2. The sheet feeder according to claim 1 including support means engageable with said retard pad to limit the degree of deflection of said retard pad from engagement of said topmost sheet with said pad during feeding.

3. The sheet feeder according to claim 1 in which said support means comprises a backing member projecting upwardly above said tray adjacent said sheet discharge end, said backing member having lower and upper sections with said lower section of said backing member being inclined at an angle of inclination greater than the angle of inclination of said tray inclined surface while said upper section of said backing member is substantially horizontal;

the lower part of said retard pad being attached to the lower section of said backing member whereby said retard pad when undeflected projects upwardly at an angle of inclination substantially equal to the angle of inclination of said backing member lower section, engagement of said topmost sheet with said retard pad deflecting the upper part of said retard pad downwardly into contact with said backing member upper section thereby allowing discharge of the topmost sheet from said tray while engagement of the leading edge of said additional sheets with said retard pad lower part prevents said additional sheets from passing through said discharge opening.

4. The sheet feeder according to claim 1 in which said sheet feeding means comprises at least one segmented roller, means supporting said roller for rotation into operative relation with said sheet stack opposite said cover opening; and drive means to rotate said roller whereby to cause said roller to engage the topmost sheet in said sheet stack and feed said topmost sheet forward.

5. A sheet feeder for feeding relatively stiff sheets for electrostatographic reproduction machines, comprising in combination:

(a) a movable tray for supporting said sheets in the form of a stack for feeding, said tray having a sheet discharge end, (b) sheet retainer means above said tray;

(c) sheet feeder means above said tray adapted to engage the topmost sheet in said stack and feed said topmost sheet from said tray;

(d) biasing means for biasing said tray in the direction of said retainer means so that said tray is raised to bring the topmost sheet in said stack into contact with said retainer means and press the sheets in said tray together;

(e) an inclined surface adjacent the discharge end of said tray engageable with the leading edges of said sheets in said stack to shingle said sheets in said tray; and (f) at least one retard pad adjacent the discharge end of said tray, said pad including a non-deflectable lower part and a deflectable upper part, said pad upper part cooperating with said retainer means to form a sheet discharge opening through which sheets are discharged from said tray by said sheet feeder means, said pad upper part normally being in a nondeflected condition preventing the discharge of sheets through said discharge opening;

(g) whereby actuation of said sheet feeder means feeds the topmost sheet and through frictional contact between sheets moves one or more of the sheets below said topmost sheet toward said discharge opening and against said retard pad, contact of said topmost sheet with said pad upper part causing said pad upper part to deflect away from said tray whereby to allow the topmost sheet to pass through said discharge opening while contact of said sheets below said topmost sheet with said pad lower part prevents discharge of said sheets from said tray.

6. The sheet feeder according to claim 5 in which said sheets are envelopes.

7. The sheet feeder according to claim 5 including support means for said retard pad comprising a backing member projecting upwardly above said tray adjacent the discharge end of said tray, said backing member having lower and upper sections with said lower section of said backing member being inclined at an angle of inclination greater than the angle of inclination of said inclined surface while said upper section of said backing member is substantially horizontal;

said retard pad lower part being attached to the lower section of said backing member whereby said retard pad when undeflected projects upwardly at an angle of inclination substantially equal to the angle of inclination of said backing member lower section, feeding of sheets from said tray deflecting the pad upper part downwardly into contact with said backing member upper section thereby allowing discharge of the topmost sheet from said tray while said pad lower part prevents the sheets below said topmost sheet from passing through said discharge opening.

8. The sheet feeder according to claim 5 in which said sheet feeder means comprises at least one segmented roller, means supporting said roller for rotation into operative relation with said sheet stack opposite said cover opening; and drive means to rotate said roller whereby to cause said roller to engage the topmost sheet in said sheet stack and feed said topmost sheet forward.

* * * * *